United States Patent [19]

Kagawa

[11] Patent Number: 4,709,708

[45] Date of Patent: Dec. 1, 1987

[54] CONTROL SYSTEM FOR HUMIDITY CONTROLLER OF TOBACCO LEAVES

[75] Inventor: Kenichi Kagawa, Hiratsuka, Japan

[73] Assignee: The Japan Tobacco & Salt Public Corporation, Japan

[21] Appl. No.: 630,064

[22] Filed: Jul. 12, 1984

[30] Foreign Application Priority Data

Jul. 21, 1983 [JP] Japan ..... 58-131976

[51] Int. Cl.[4] ..... A24B 3/02; A24B 3/04

[52] U.S. Cl. ..... 131/302; 131/303

[58] Field of Search ..... 131/300, 301, 302, 303, 131/304, 305

[56] References Cited

U.S. PATENT DOCUMENTS 3,840,025 10/1974 Fawler et al. ..... 131/303
3,905,123 9/1975 Fawler et al. ..... 131/303
4,045,657 8/1977 Falke ..... 131/303

FOREIGN PATENT DOCUMENTS 2240682 3/1974 Fed. Rep. of Germany ..... 131/303

*Primary Examiner*—V. Millin

[57] ABSTRACT

A system for controlling the water content and temperature of tobacco leaves in a humidity controller is provided. Said system comprises means for measuring the water content, temperature and flow rate of the tobacco leaves conveyed to the humidity controller which provides the tobacco leaves with the water content and temperature necessary for rib removal to maintain the quality of the tobacco leaves; operation means for calculating the amount of water and steam to be added upon the basis of the measurements of said measuring means and the preset values representative of the water content and temperature provided to the tobacco leaves and for compensating for the deviation between the spraying position of water and steam and the position of measuring the water content and the temperature of the tobacco leaves which have been provided with water and steam and the time lag of rise up and fall of the water content and temperature when the preset values are changed; and control means for controlling means for supplying the water and steam in response to the values calculated by the operation means and for correcting the deviation between the measurements of the water content and temperature of the tobacco leaves provided with water content and steam and the preset values.

9 Claims, 4 Drawing Figures

CONTROL SYSTEM FOR HUMIDITY CONTROLLER OF TOBACCO LEAVES

BACKGROUND OF THE INVENTION

The present invention relates to a control system for a humidity controller for tobacco leaves, particularly to a control system for a humidity controller in which the water content and temperature of the tobacco leaves are controlled to a given value in the material treatment.

In general tobacco production process, tobacco leaves used for raw material are separated each other and are provided with a flexibility by the addition of water and steam. Thereafter they are separated into the ligneous parts (or ribs) and the parenchyma (or laminae). The laminae are dried to possess 12% of water content for avoiding change in quality and molding during long term storage and then packed in a barrel or other container (above-mentioned process be referred to as a raw material treating process). The packed laminae are stored for a long time for maturing. The laminae which have finished maturing are threshed into cut cigarett after the steps of leaf orientation, blending and flavoring.

During the raw material treating process, a flexibility necessary to rib removing is imparted to the tobacco leaves by providing water and steam thereto when they are passed through a cylindrical humidity controller. The amount of water and steam gives a great influence upon yield and quality of raw material. In other words the tobacco leaves are subjected to great mechanical action, when they are separated into laminae and ribs. Accordingly separation between laminae and ribs is not sufficiently accomplished, or conversely excessive separation is accomplished so that the tobacco leaves are finely divided depending upon the physical properties possessed by the tobacco leaves. Therefore it is most important to control the water content and temperature of the tobacco leaves within a predetermined range, which have a strong relation with the physical properties of the tobacco leaves.

Operation of the humidity controller has heretofore been manually controlled. The water content and temperature of the tobacco leaves at the exit of the humidity controller are measured by the sense of touch of an operator to compare them to the preset values. The operator operates values to change the amount of water and steam to be added where there is a deviation therebetween. However measurement of the water content and temperature of the tobacco leaves by the sense of touch requires long experience and good perception of the operator. It is almost impossible to manually control the water content and temperature at the exit of the humidity controller at constant levels since the water content of the tobacco leaves varies from 9% to 21% by wetting standards at a cycle of 30 seconds to one minute and the humidity controller has a time lag of approximately three minutes and dead time of approximately two minutes.

SUMMARY OF THE INVENTION

It is therefore an object of the present invention to provide a novel system for controlling the water content and temperature of tobacco leaves to predetermined value in a humidity controller without using manpower.

The object of the present invention is accomplished by providing a system for controlling the water content and temperature of tobacco leaves in a humidity controller comprising means for measuring the water content, temperature and flow rate of the tobacco leaves conveyed to the humidity controller which provides the tobacco leaves with the water content and temperature necessary for rib removal to maintain the quality of the tobacco leaves; operation means for calculating the amount of water and steam to be added upon the basis of the measurements of said measuring means and the preset values representative of the water content and temperature provided to the tobacco leaves and for compensating for the deviation between the spraying position of water and steam and the position of measuring the water content and the temperature of the tobacco leaves which have been provided with water and steam and the time lag of rise up and fall of the water content and temperature when the present values are changed; and control means for controlling means for supplying the water and steam in response to the values calculated by the operation means and for correcting the deviation between the measurements of the water content and temperature of the tobacco leaves provided with water content and steam and the preset values.

DESCRIPTION OF THE PREFERRED EMBODIMENT

The present invention will be described by way of an embodiment with reference to the drawings.

Figure 1:
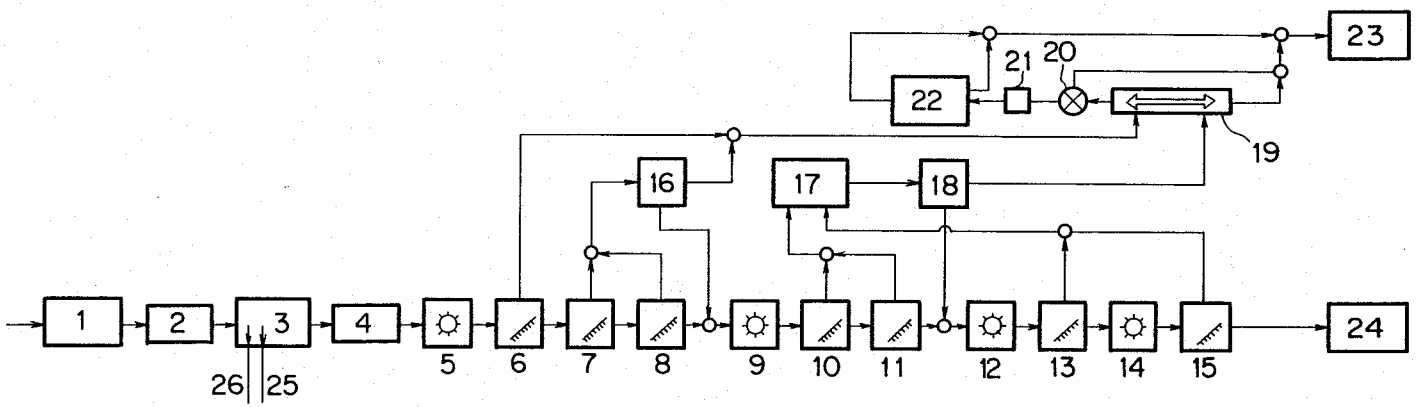
FIG. 1 is a block diagram showing the steps for processing the raw material.

Referring now to FIG. 1, there is shown a sequence of process for treating raw material tobacco leaves. The tobacco leaves which have been supplied from a supplying machine 1 are controlled to be conveyed at a given flow rate by a flow rate controller 2 and then supplied to a humidity controller 3 where they are provided with a flexibility necessary for rib removal by adding water and steam thereto sprayed from a water supply nozzle 25 and a steam nozzle 26 respectively. The tobacco leaves which have finished the humidity control are separated into the parenchyma (or laminae)and the ligneous parts (or ribs) by means of rib removing units 5, 9, 12 and 14 and further separated by separating units 6, 7, 8, 10, 11, 13, 15, 16 and 18.

In FIG. 1 reference numerals 4 and 21 depict feeders; 17 and 19 conveyor assemblies; 20 a sampler; 22 a quality determining unit; and 23 and 24 silos.

Figure 2:
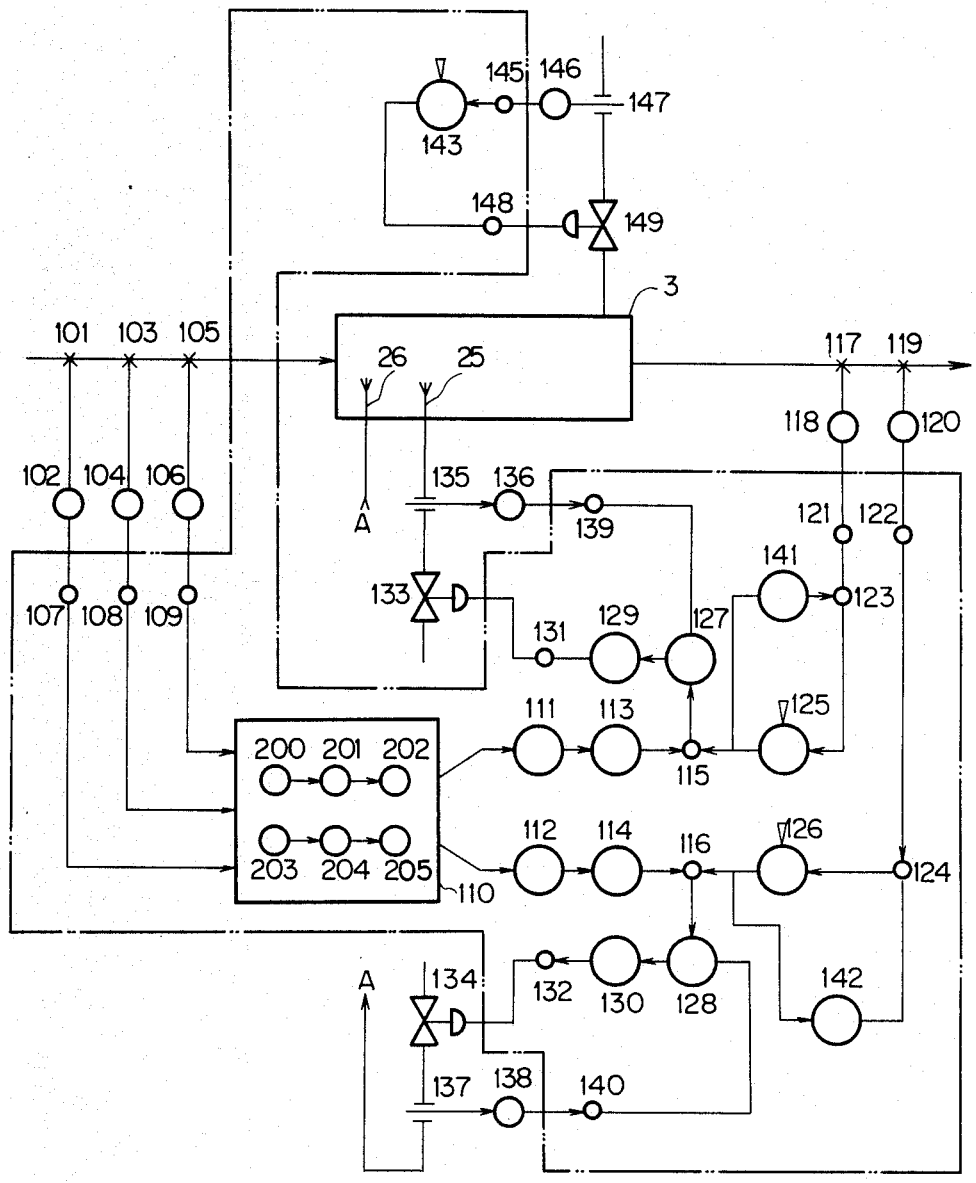
FIG. 2 is a block diagram showing a control system of the present invention.

Referring now to FIG. 2, there is shown an example of a control system of the present invention. An infrared moisture or water content meter 102 is provided at a water content detecting portion 101 located in the entrance of the humidity controller 3 for measuring the water content of the tobacco leaves. A temperature resistance transducer 104 is provided at a temperature detecting portion 103 located in the entrance of the humidity controller 3 for measuring the temperature of the tobacco leaves. A displacement flow rate transducer 106 is provided at a tobacco leaves' flow rate detecting portion 105 located at the entrance of the humidity controller 3. The analog values representative of water content, temperature and flow rate which are detected by the detectors 102, 104 and 106 are sampled at predetermined intervals by means of samplers 107, 108 and 109 and then converted into digital values by analog to digital convertors.

An operation unit 110 serves to calculate an amount of water to be added Q and an amount of steam G which are to be given to the tobacco leaves in accordance with the digital values so that the tobacco leaves have appropriate humidity or water content and temperature. The water addition amount Q and the steam amount G are determined by the formulae (1) and (2) of equilibrium between material and heat at the entrance and exit of the humidity controller 3.

$$Q = \frac{1}{kq} w(1 - \omega_1)\left\{ (\omega_{2s} - \omega_1) - \frac{1}{rm}\left(c + \frac{\omega_1 + \omega_{2s}}{2}\right)(tm_{2s} - tm_1) \right\} \quad (1)$$

$$G = \frac{1}{kq \times r}\left\{ w\left(c + \frac{\omega_1 + \omega_{2s}}{2}\right)(tm_{2s} - tm_1) - \delta \right\} \quad (2)$$

wherein w is a flow rate of the raw material (kg/hr); rm is a condensation latent heat; c is a specific heat; kq and kg are coefficients; r is an enthalpy of the steam; and $\delta$ is an temperature elevation due to addition of water and heating. These parameters depend upon the operation conditions. $\omega_1$ and $tm_1$ respectively represent the measurements of the water content and temperature of raw material (tobacco leaves) conveyed to the humidity controller 3. Furthermore $\omega_{2s}$ and $tm_{2s}$ which represent preset values of the water content and temperature given to the raw material at the humidity controller 3 are set in PiD adjusters 125 and 126 as will be hereafter described.

When the preset value of temperature of the tobacco leaves is changed, the humidity or water content is changed for example, due to temperature elevation. The change in water content is instantly compensated for by the second term of the formula (1).

$$\frac{1}{rm}\left(c + \frac{\omega_1 + \omega_{2s}}{2}\right)(tm_{2s} - tm_1)$$

However the amount of water to be added Q is calculated by adding the signal which has been compensated by a primary lag compensator 200 and a first order lag compensator 201 to the first term of the formula (1) ($\omega_{2s} - \omega_1$) since there are offset between the spraying positions of water and steam (water nozzle 25 and steam nozzle 26) and the measuring positions of the water content and temperature of the tobacco leaves which have been provided with water and steam (water content and temperature detecting portion 117 and 119) and there is a time lag of the temperature elevation of the material (first order lag characteristics). The steam amount G is calculated upon basis of the signal which has been compensated for by a phase compensator 203 and a first order lag compensator 204 as is done similarly to calculation of water amount Q.

The results of the calculation by formulae (1) and (2), that is, the outputs of the operation units 202 and 205 are passed through the phase compensators 111 and 112 which compensate for the time lag between the measuring positions of water content, temperature and flow rate (water content detecting portion 117 and temperature detecting portion 119) and the atomization position of water and steam (the water nozzle 25 and the steam nozzle 26) and distribution compensators 113 and 114 which compensate for an manipulating variable depending upon the distribution of the material in the humidity controller and then applied to adders 115 and 116 where they are converted into cascade preset values for the PiD adjustors 127 and 128.

On the other hand, on the exit side of the humidity controller 3 (at the right portion of FIG. 2) there are provided a water content detecting portion 117, infrared water content meter 118, temperature detecting portion 119 and a temperature-resistance transducer 120.

The analog values of the water content and temperature measured by the infrared water content meter 118 and the temperature-resistance transducer 120 at the exit of the humidity controller 3 are sampled by samplers 121 and 122 at intervals of one half to one dead time of the humidity controller 3 and then converted to digital values by analog to digital convertors. The digital values are passed through a filter to effectively remove the transient therein and then applied to PiD adjustors 125 and 126 as a feed back signal.

The preset values $\omega_{2s}$, $tm_{2s}$ representative of a water content and temperature to be imparted to the tobacco leaves are stored in the PiD adjusters 125 and 126 in which the preset values $\omega_{2s}$ and $tm_{2s}$ are compared to the aforementioned digital signals. When there is a deviation therebetween, PiD adjusters serves to carry out PiD compensation and to provide a signal to the aforementioned adders 115 and 116. This causes the cascade preset values of the PiD adjusters 127 and 128 to correct.

Control values 133 and 134 which are provided at the water nozzle 25 and the steam nozzle 26 are controlled by output signals from the PiD adjusters 127 and 128 respectively. That is, the amount of water and steam which are supplied to the water adding and steam nozzles 25 and 26 via orifices 135 and 137 along their passages are measured at the pressure flow rate convertors 136 and 138 and then analog-digital converted by the A/D converters 139 and 140 respectively to provide feed-back outputs to the PiD adjusters 127 and 128. The PiD adjusters 127 and 128 serve to PiD compensate for the deviations between measured values and cascade preset value to apply signals to control values 133 and 134 for correcting the deviations. The output signals are passed through the compensators 129 and 130 which improve the characteristics of the control valves 133 and 134 and converted to analog values at predetermined intervals by the D/A converters 131 and 132 and then applied to the control valves 133 and 134. This causes the opening of the control valves 133 and 134 to be adjusted.

The outputs from the above-mentioned PiD adjusters 125 and 126 are compensated for the dead time of the humidity controller 3 by means of the dead time compensators 141 and 142 and then applied to the adders 123 and 124.

The amount of the air in the humidity controller 3 is adjusted by the control valve 149 which is controlled by the PiD adjuster 143. The preset value of the air amount is preliminarily stored in the PiD adjuster 143. The air amount is measured by pressure/flow rate transducer 146 via an orifice 147 disposed at an air passage so that it is analog-digital converted by the A/D convertor 145 to provide a feed back output. The deviation between the preset value and the measurement is PiD compensated so that the control valve 149 is controlled to correct the deviation. Reference numeral 148 in FIG. 2 represents a D/A convertor.

The operation of the above-mentioned embodiment will be described.

A given water content and temperature are preset in the PiD adjusters 125 and 126 respectively at first. Tobacco leaves which are raw material are conveyed by means of the flow rate control unit 2 under these conditions. The water content, temperature and flow rate of the tobacco leaves being conveyed are measured by the infrared water content meter, temperature resistance transducer 104 and displacement flow rate transducer 106 respectively at the entrance of the humidity controller 3.

These measurements are converted to digital values and then applied to the operation portions 202 and 205 of the operational unit 110 in which the amounts of water and steam to be added are calculated in accordance with the formulae 1 and 2. After the calculated values are compensated for by the phase compensators 111 and 112, they are applied to the PiD adjusters 127 and 128 from the adders 115 and 116 as cascade preset values. The PiD adjusters 127 and 128 control the control valves 133 and 134 respectively in response to the cascade preset values corresponding to the amount of water and steam to be added. This causes the water and steam nozzles 25 and 26 to spray the water and steam onto the tobacco leaves being conveyed through the humidity controller 3.

The water content and the temperature of the tobacco leaves which have been provided with water and temperature are measured by the infrared water content meter 118 and temperature resistance transducer 120 respectively at the exit of the humidity controller 3 before they are conveyed to a rib removing unit 5 which carries out the subsequent step. These measurements are applied to PiD adjusters 125 and 126 as feedback signals where they are compared to the preset values. If there is a deviation therebetween the PiD adjusters serve to PiD adjust the signals, which are applied to the adders 115 and 116. This causes the aforementioned cascade preset values to be corrected.

The measurements of the water content and temperature which have been measured through the orifices 135 and 137 are input to the PiD adjusters 127 and 128 as feed back signals so that the amount of water and steam to be added is optimally controlled by the corrected cascade preset value and feed back signal.

When the temperature of the tobacco leaves is changed, the preset value of the PiD adjuster 126 is changed. At this time, the phase compensators 200 and 203 and the first order lag compensators 201 and 204 serve to compensate for the signals (measurements of water content, temperature and flow rate) which are to be applied to the operation unit 110 to avoid the temporary shortage and excess of the water to be added. This will be described with reference to FIGS. 3*a* to 3*e*.

Figure 3:
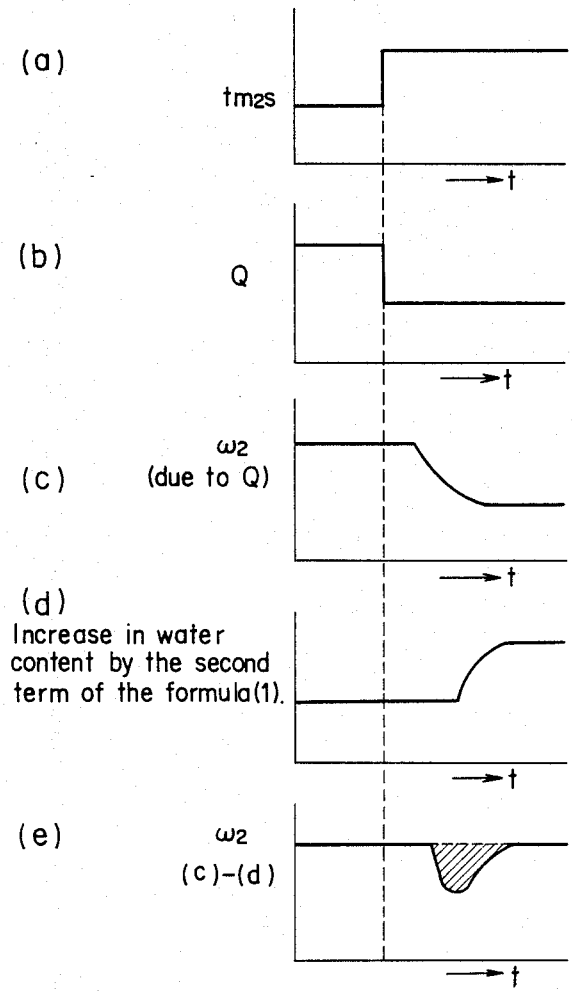
FIGS. 3*a* to 3*e* and FIGS. 4*a* to 4*e* are graphs showing the function of the system.
Figure 4:
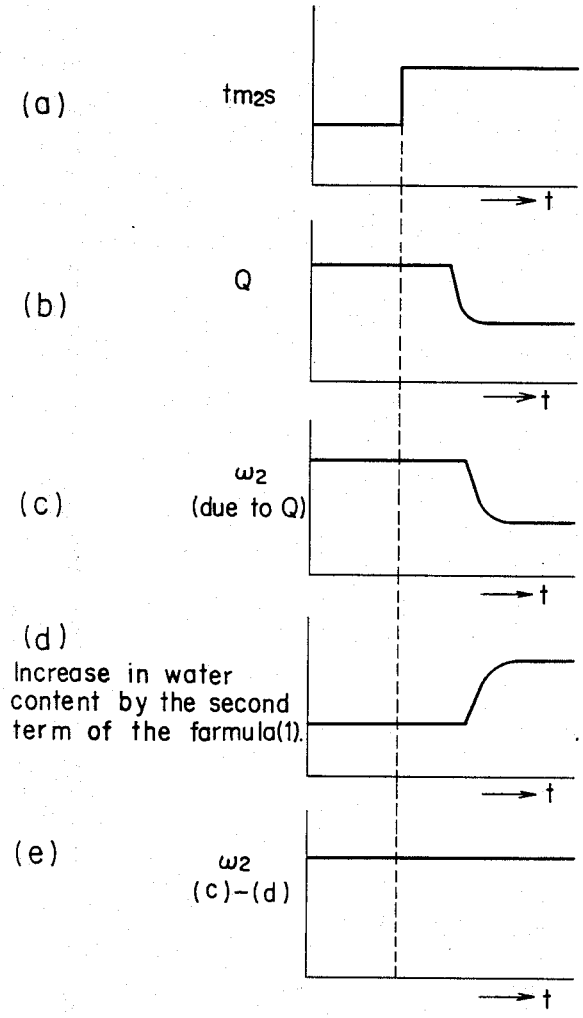

For example when the preset value of the material temperature $tm_2s$ is increased as shown in FIG. 3*a*, the amount of water to be added Q is instantly compensated for by the second term of formula (1)

$$\frac{1}{rm}\left(c + \frac{\omega_1 + \omega_2 s}{2}\right)(tm_2 s - tm_1)$$

as shown in FIG. 3*b*. However a time lag takes place since there is a deviation in position between the water and steam nozzles 25 and 26 and the water content and temperature detecting portions 117 and 118 and there is a primary time lag characteristic of temperature. Accordingly the water content of the tobacco leaves changes as shown in FIG. 3*c*, while the water content increases according to the second-term of formula 1. This means there is a time lag. Thus, the actual water content which is provided to the tobacco leaves is temporarily decreased by an amount represented by dotted lines in FIG. 3*e*.

The control system of the present invention has the following advantages.

(1) Accuracy of measurement is improved in comparison to conventional measuring by sense of touch since it is possible to automatically measure the water content, temperature and flow rate of the tobacco leaves at the exit of the humidity controller.

(2) The variations of the water content and the temperature at the entrance of the humidity controller may be reduced by measuring the water content, temperature and flow rate of the leaves at the entrance of the humidity controller for controlling the amount of water and steam to be added.

(3) Error does not occur even in the transition of the water content and the temperature at the entrance of the humidity controller since water and steam are sprayed in accordance with the material distribution condition in the humidity controller.

(4) There is no adverse temporary shortage or excess of the water content of the tobacco leaves immediately after the change of the preset value since the amount of water and steam to be added are calculated so that the deviation between the spraying position of water content and steam and the measuring position of the water content and the temperature of the tobacco leaves which have been provided with water and steam and the time lag of rise up and fall of the water content and temperature are compensated for. This prevents unqualified products from being produced.

What is claimed is:

1. A system for controlling the water content and temperature of tobacco leaves in a humidity controller comprising (1) means for measuring the water content, temperature and flow rate of the tobacco leaves conveyed to the humidity controller which provides the tobacco leaves with the water content and temperature necessary for rib removal to maintain the quality of the tobacco leaves;

(2) operation means for calculating the amount of water and steam to be added upon the basis of the measurements of said measuring means and the preset values representative of the water content and temperature provided to the tobacco leaves and for compensating for deviation existing between a spraying position of water and steam and a position of measuring the water content and the temperature of the tobacco leaves which have been provided with water and steam and the time lag of rise up and fall of the water content and temperature when the preset values are changed; and (3) control means for controlling means for supplying the water and steam in response to the values calculated by the operation means and for correcting the deviation between the measurements of the water content and temperature of the tobacco leaves provided with water content and steam and the preset values.

2. The control system defined in claim 1 in which said operation means includes a phase compensator for compensating for the offset between the spraying position of water and steam and the position of measuring the water content and temperature of the tobacco leaves which have been provided with water and steam and a first order lag compensator for compensating for the time lag of rise up and fall of the water content and temperature when the preset values thereof are changed.

3. The control system defined in claim 1 in which said operation means calculates the amounts of water and steam to be added Q and G in accordance with formulae (1) and (2) respectively.

4. The control system defined in claim 1 in which said control system includes a first PiD adjuster having an input coupled to means for measuring the water content and temperature of the leaves which have been provided with water and steam, in which preset values of the water content and temeprature of the leaves are stored;

adder means to which the outputs of said first PiD adjuster and said operation means are connected; and a second PiD adjuster having an input connected with said adder and an out-put connected to said means for supplying the water and steam.

5. The control system defined in claim 4 in which the output of the first PiD adjuster is fed back to the input thereof.

6. The control system defined in claim 4 in which the measurements of the amount of supplied water and steam are fed back to the input of the second PiD adjuster.

7. An apparatus for controlling water content and temperature of tobacco leaves in a humidity controller according to claim 1 in which said operation means includes (A) a phase compensator to compensate for, when the preset values are changed while the humidity controller is being operated, the time required for the tobacco leaves sprayed with water and steam to travel the distance between the position of the spraying and the position of measuring the water content and the temperature of the tobacco leaves at the outside of the exit of the humidity controller; and (B) a first order lag compensator to compensate for, when the preset values are changed while the humidity controller is being operated, the time lag of rise and fall of the water content and temperature of the tobacco leaves.

8. An apparatus for controlling water content and temperature of tobacco leaves in a humidity controller according to claim 1 in which said operation means calulates an amount, Q of water and an amount, G of steam by equations $$Q = \frac{1}{Kq} W(1 - w1)\left\{ (w2s - w1) - \frac{1}{rm}\left( C + \frac{w1 + w2s}{2} \right) (tm2s - tm1) \right\} \quad (1)$$

and $$G = \frac{1}{Kgr}\left\{ W\left( C + \frac{w1 + w2s}{2} \right) (tm2s - tm1) - \delta \right\} \quad (2)$$

where,

Q; an amount of water to be given to the tobacco leaves,

G; an amount of steam to be given to the tobacco leaves,

W; flow rate measured by said first group of measuring means, rm; a condensation latent heat, C; specific heat, Kg; efficiency, Kg; efficiency, r; enthalpy of steam, tml; temperature measured by said first measuring means, tm2s; preset value of temperature to be given to the tobacco leaves, δ; temperature rise due to adding water and heating, wl; water content measured by said first measuring means and w2s; preset value of water content of the tobacco leaves.

9. In an apparatus for controlling water content and temperature of tobacco leaves in a humidity controller having (A) water-spraying means and steam-spraying means mounted inside the humidity controller near its entrance for giving the tobacco leaves an optimum water content and temperature to assure their quality in a subsequent rib removal process;

(B) a first group of measuring means mounted immediately before the entrance of the humidity controller for measuring water content, temperature, and flow rate of the tobacco leaves before they are conveyed into the humidity controller;

(C) a second group of measuring means mounted at the outside of the exit of the humidity controller for measuring water content and temperature of the tobacco leaves discharged from the humidity controller;

(D) arithmetic operation means for calculating an amount of water and an amount of steam to be given to the tobacco leaves on the basis of the measurements by said first group of measuring means and preset values representative of said optimum water content and temperature; and (E) control means for controlling the water-spraying means and the steam spraying-means in response to the amounts calculated by said arithmetic operation means, and in response to the difference between said preset values and the measurements by said second measuring means so as to reduce said difference;

said arithmetic operation unit performs, when said preset values are changed while the humidity controller is being operated, calculation of an amount of water and an amount of steam to be given to the tobacco leaves on the basis of (i) the measurement by said first group of measuring means and new preset values representative of water content and temperature to be newly set;

(ii) the time required for the tobacco leaves sprayed with water and steam to travel the distance between the position of the spraying and the position of measuring the water content and the temperature at the outside of the exit of the humidity controller; and (iii) the time required for the measurement by said second measuring means to reach said new preset values.

* * * * *